US006010022A

United States Patent [19]

Deaton

[11] Patent Number: 6,010,022

[45] Date of Patent: Jan. 4, 2000

[54] DISPENSING BOX FOR FLOWABLE MATERIAL

[75] Inventor: Thomas P. Deaton, Mason, Ohio

[73] Assignee: Buckhorn, Inc., Milford, Ohio

[21] Appl. No.: 08/842,506

[22] Filed: Apr. 24, 1997

Related U.S. Application Data

[63] Continuation-in-part of application No. 08/802,342, Feb. 11, 1997, Pat. No. 5,845,799, which is a continuation of application No. 08/245,641, May 18, 1994, abandoned.

[51] Int. Cl.[7] ..... B65D 1/42; B65D 6/24; B65D 6/26

[52] U.S. Cl. ..... 220/4.03; 220/4.26; 220/8; 220/601; 220/653; 220/666

[58] Field of Search ..... 220/6, 8, 4.21, 220/4.24, 4.26, 4.27, 4.03, 4.28, 601, 653, 666, 1.5, 212, 23.83, 23.86, 626; 206/501, 505, 507, 517; 229/101, 117.02

[56] References Cited

U.S. PATENT DOCUMENTS

| | | | |
|---|---|---|---|
| 1,778,588 | 10/1930 | Ebersole . | |
| 2,582,207 | 1/1952 | Shaw | 206/501 |
| 2,675,947 | 4/1954 | Wynn . | |
| 2,887,251 | 5/1959 | Mackridge . | |
| 3,083,879 | 4/1963 | Coleman | 220/4.03 |
| 3,121,408 | 2/1964 | Haning | 220/4.26 |
| 3,329,317 | 7/1967 | Greenquist . | |
| 3,883,005 | 5/1975 | Stevens | 220/4.03 |
| 4,426,015 | 1/1984 | Preston et al. | 220/653 |
| 4,674,647 | 6/1987 | Gyenge et al. . | |
| 4,724,976 | 2/1988 | Lee | 220/8 |
| 5,094,356 | 3/1992 | Miller . | |
| 5,253,777 | 10/1993 | Schutz . | |
| 5,409,126 | 4/1995 | DeMars | 220/4.27 |
| 5,437,384 | 8/1995 | Farrell | 220/1.5 |
| 5,494,350 | 2/1996 | Childress | 220/4.26 |
| 5,617,679 | 4/1997 | Meyers | 220/8 |
| 5,626,253 | 5/1997 | Schutz | 220/653 |

*Primary Examiner*—Stephen P. Garbe
*Assistant Examiner*—Niki M. Eloshway
*Attorney, Agent, or Firm*—Beall Law Offices

[57] ABSTRACT

A two-part container has a base and a ring. Latches along the lower part of the ring secure the ring to the base and the container is assembled in an upright position in which a flowable material is charged into the container. To dispense the material, a center outlet is provided in the base and the interior walls of the base are slanted toward the outlet. A cutoff device slides across the opening to control the flow of material through the outlet, and the cutoff device can be blocked into place. Once the container is emptied, the ring can be removed and inverted in its orientation and placed over top of the base for assembling the ring and base in a collapsed position in which the container can be returned to the distributor or distribution center. The container is stackable in both the upright and collapsed positions, and the lid sits over the top of the ring when it is assembled in the upright position and over the bottom of the ring when it is assembled in the collapsed position.

10 Claims, 9 Drawing Sheets

DISPENSING BOX FOR FLOWABLE MATERIAL

This application is a continuation-in-part application of U.S. application Ser. No. 08/802,342, filed Feb. 11, 1997, now U.S. Pat. No. 5,845,799, which is a continuation application of U.S. application Ser. No. 08/245,641, filed May 18, 1994, now abandoned, the disclosures of which are herein incorporated by reference.

FIELD OF THE INVENTION

The invention relates to a container for containing and dispensing a flowable material, and in particular to a stackable container that can be collapsed for return shipment of an empty container for reuse of the container.

BACKGROUND OF THE INVENTION

Knock down bulk boxes having collapsible side and end walls are suitable for dispensing a flowable material, if modified to include a dispenser in the base of the container and an insert in the interior of the box for directing the flowable material to the dispensing outlet. Knock down bulk boxes have the advantage of providing stacking features and forklift handling of large quantities of a flowable material, such as seed like soybean or corn; or other flowable products, such as glue pellets. The advantages with bulk boxes is that upon return shipment after delivery of the flowable material, the sides can be collapsed and the container reduced in size for efficient return handling of the empty container.

SUMMARY OF THE INVENTION

By providing a dispensing outlet for flowable material in the base of the bulk box in combination with an insert that directs the flowable material to the outlet, a bulk box can be used for containing, shipping and dispensing a flowable material. However, there are many component parts in a bulk box and the bulk box construction tends to have cracks in the corners, which is not ideal from the viewpoint of containing a flowable material having a small particle size, such as seed.

It is an object of the invention to provide a large capacity container having a dispensing outlet that permits flowable material to be dispensed out of at least the side or bottom of the container through the outlet.

It is a further object of the invention to provide a container having two parts including a base and a ring.

It is yet another object of the invention to provide a container having a base in the ring wherein the ring is stacked on the base in an upright position for containing a flowable material and collapse to a position wherein the base and ring are nested with respect to one another for return of the container.

It is yet a further object of the invention to provide a container having a base in the ring construction with a lid that permits stacking of the containers when in their upright position and stacking of the containers when in their collapsed position.

It is an object of the invention to provide a large capacity container having a ring and a base that can be assembled in an upright position with the ring secured to the ring of the base for containing a flowable material therein, and further manipulated to a collapsed position wherein the ring is inverted with respect to its orientation in the upright boxed position so that it slides over the base and collapses to provide 2 to 1 height reduction for return shipment.

It is an object of the invention to provide the two part container that can be assembled in an upright position or in a collapsed position that has a dispensing outlet with a cut off device that cuts off the flow of the flowable material through the dispensing outlet and that adjusts the rate of the flow depending upon the extent to which the cut off device extends across the dispensing outlet.

DETAILED DESCRIPTION OF THE PREFERRED EMBODIMENTS

Figure 1:
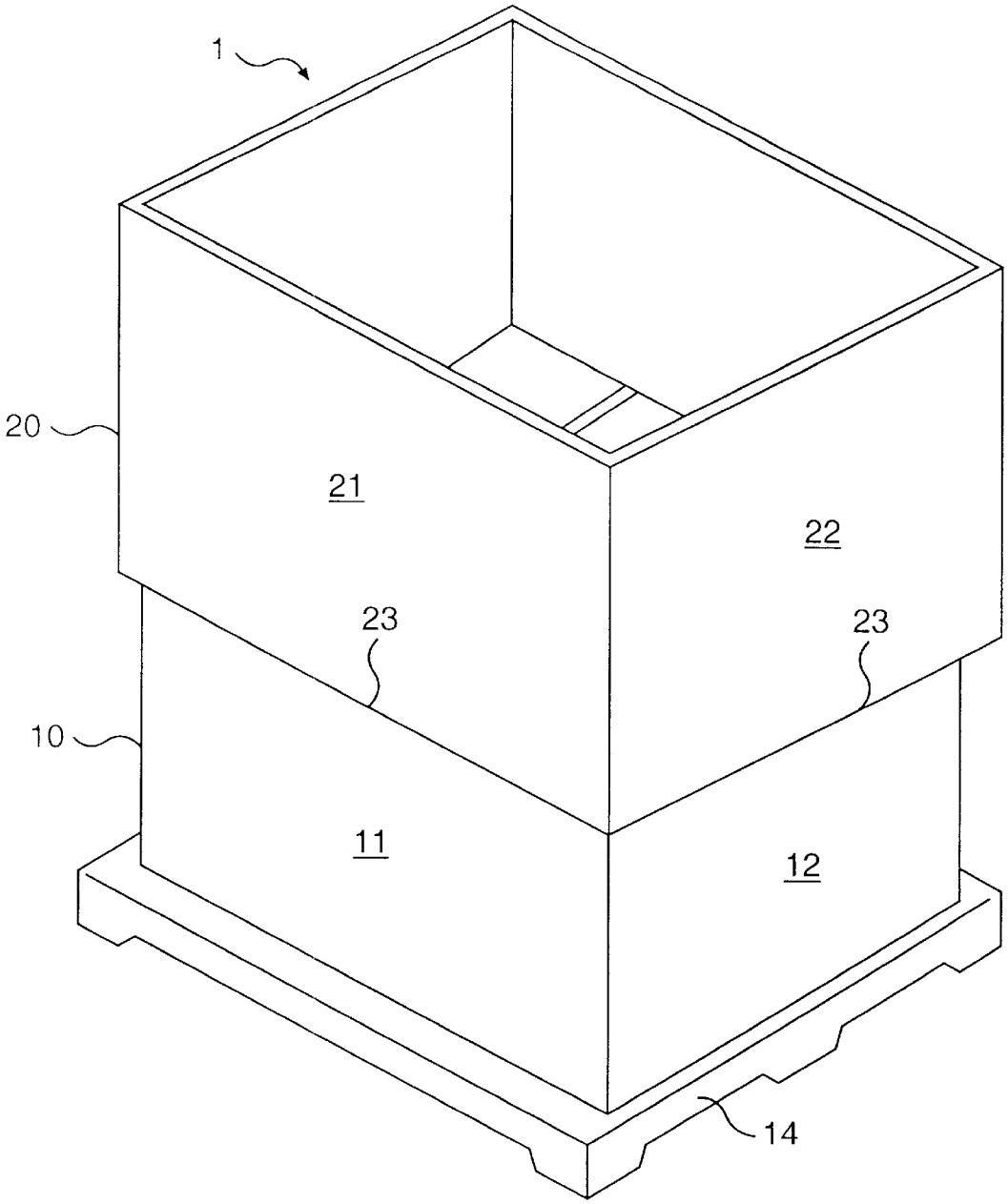
FIG. 1 is a schematic perspective view of the container of the present invention shown in an upright position.

FIG. 1 shows a schematic perspective view of the two piece container constructed according to the present invention. Container 1 has a base 10 on which is mounted a ring 20. Base 10 has side walls 11 and end walls 12. Ring 20 has side walls 21 and end walls 22. As shown, the bottom part 23 of ring 20 is mounted to the top of base 10.

In the upright position shown in FIG. 1, the container is in position for containing a flowable material, such as seed or other pellet material. Once full of the flowable material, the container is covered with a lid 5 shown in FIG. 2.

Figure 2:
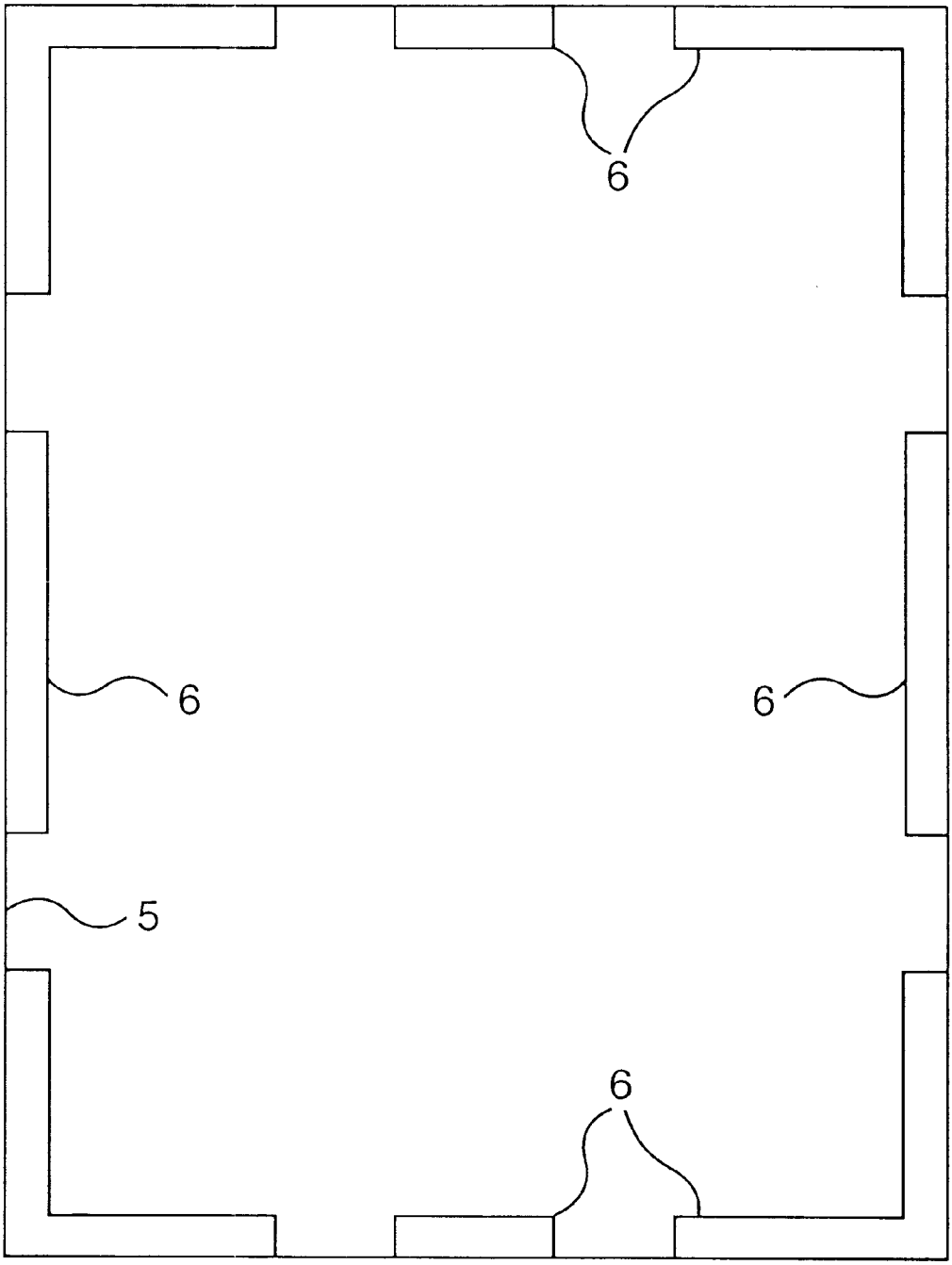
FIG. 2 is a top plan view of a lid for the container shown in FIG. 1.

The base 10, as shown generally in FIG. 1 and in greater detail in FIGS. 5–10 has a bottom part 14 that engages the ground for supporting the container that includes a bottom flange 15, and which further has areas in which the tines of a forklift can be inserted for handling the container beside which are hit plates 18. Also, the bottom part 14 has an arrangement of flanges that correspond with the stacking ridges 6 formed on the lid 5, as shown in FIG. 2. This enables containers filled with a flowable material to be stacked one on top of the other for efficient handling of the containers.

The containers are of a large capacity of holding several hundred pounds of a flowable material. For dispensing the material at a destination, a dispensing outlet is formed in the bottom wall of base 10. Once the container has been emptied and is to be returned, the ring 20 is inverted from its orientation shown in FIG. 1 and slid down along the periphery of base 10 to achieve the collapsed position shown in FIG. 3.

Figure 3:
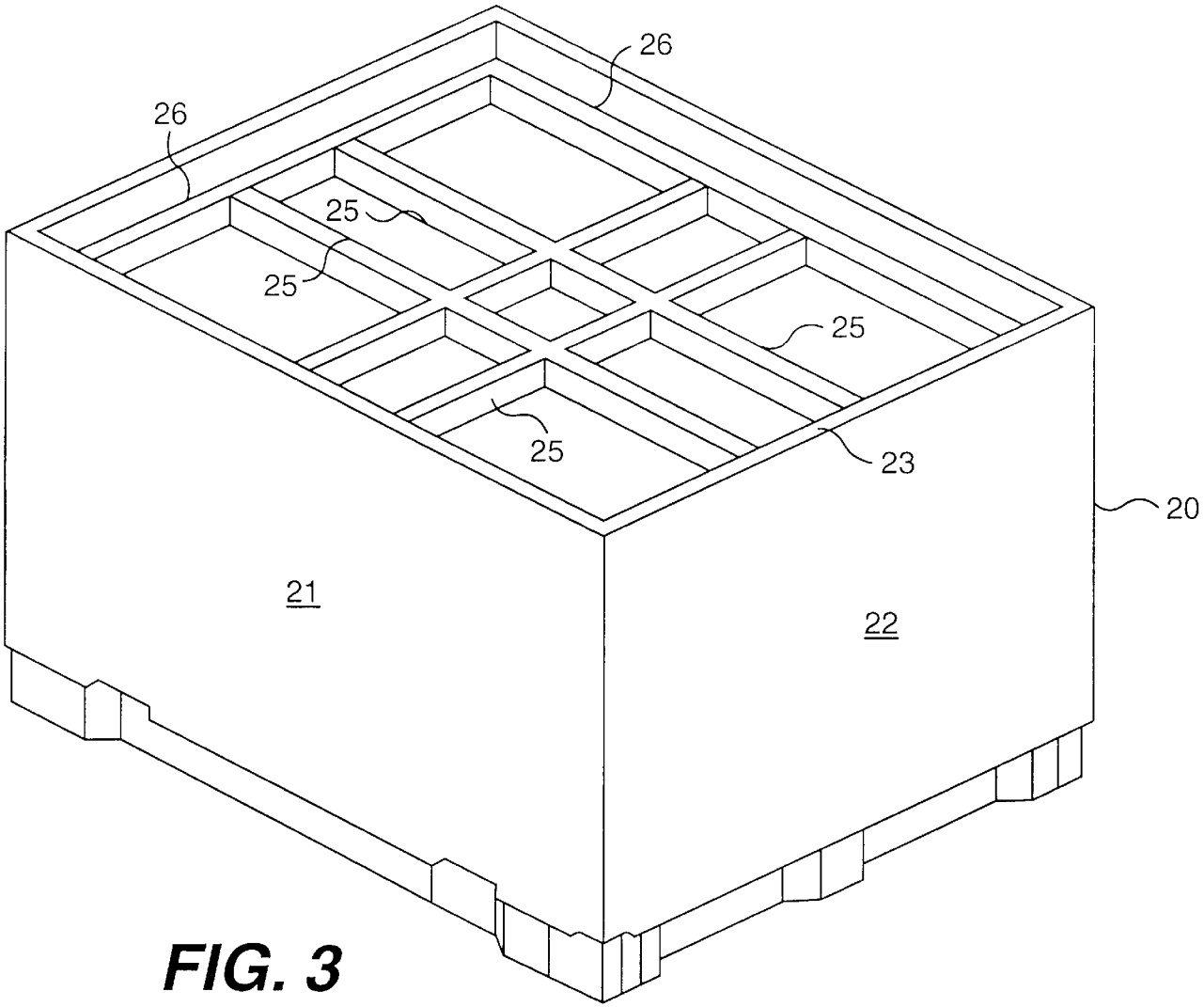
FIG. 3 is a perspective view of the container shown in FIG. 1 in a collapsed position.

As shown in FIG. 3, the bottom part of ring 20 is shown at the top of the drawing and struts 25 are shown spanning the opening of the ring 20. Struts 25 and an inner peripheral flange structure 26, shown schematically in FIG. 3, enables the ring 20 to be secured to base 10 while maintaining the structural integrity of the ring, which does not have a bottom wall per se, as does the base. Rather, the struts 25 form the structural stability required of the ring while still letting the flowable material pass through the openings between adjacent struts 25. The struts 25 are included in the preferred embodiment, without which containers of this size would have bulging side walls and end walls and would be at risk of being unsafe when made from most plastic materials.

Figure 4:
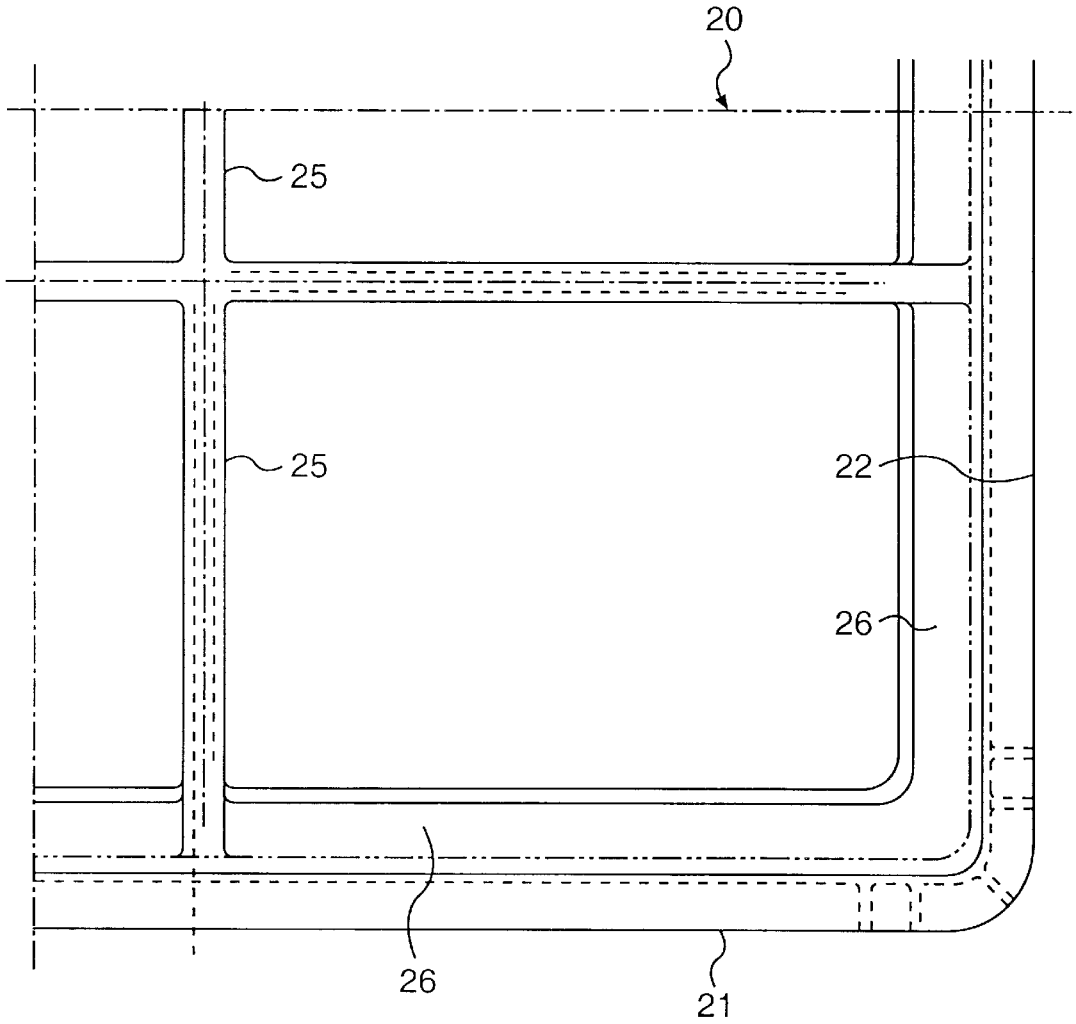
FIG. 4 is a partial top plan view of the ring part of the container shown in FIG. 3.

FIG. 4 shows the details of a preferred embodiment of the bottom of ring 20 in partial plan view. One quarter of the bottom plan view of the ring 20 is shown in FIG. 4.

FIGS. 5–10 show a preferred embodiment of the invention, discussed herein as follows.

Figure 5:
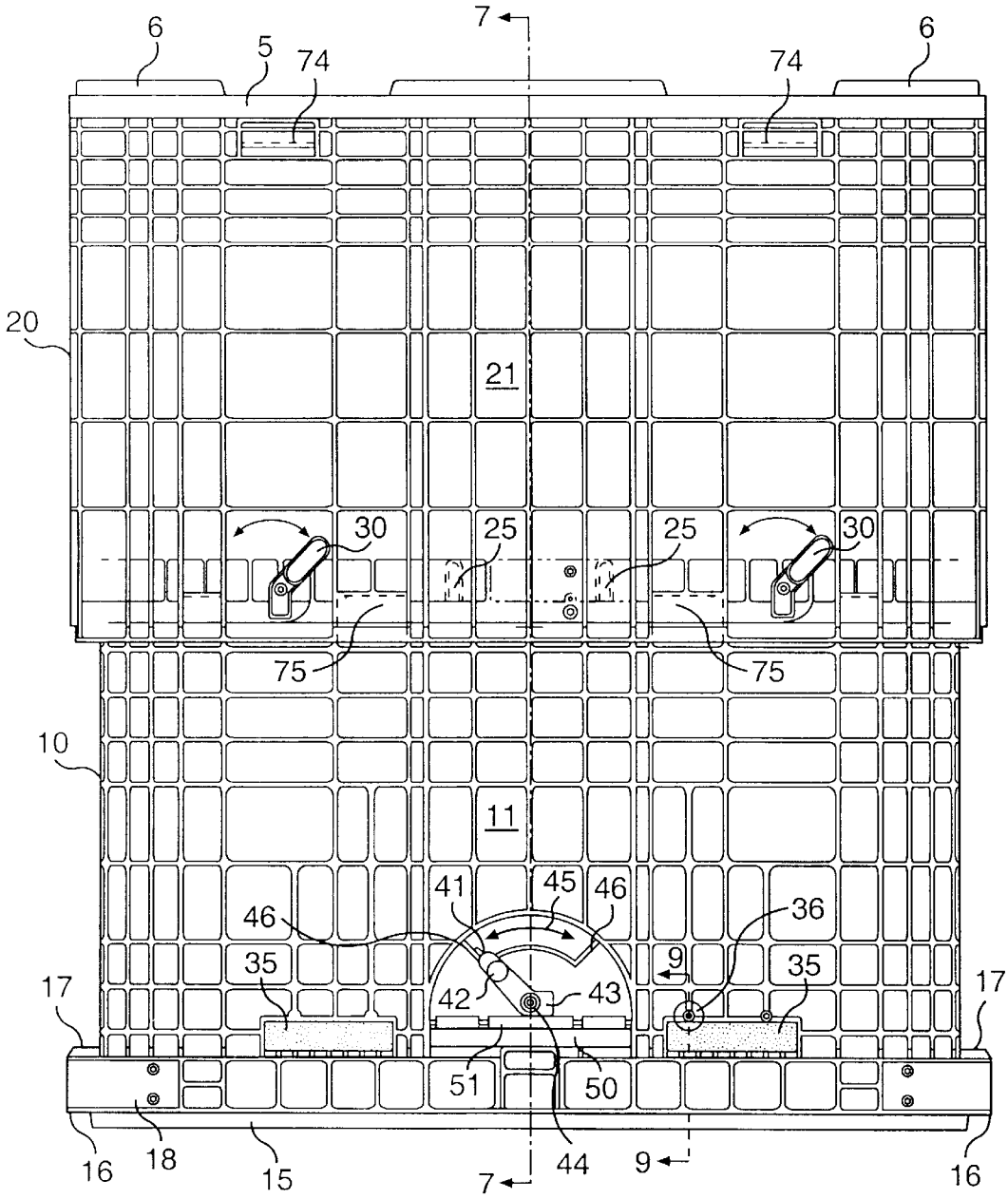
FIG. 5 is a side elevation of a container having a base and ring assembled in an upright position, according to a preferred embodiment of the invention.
Figure 6:
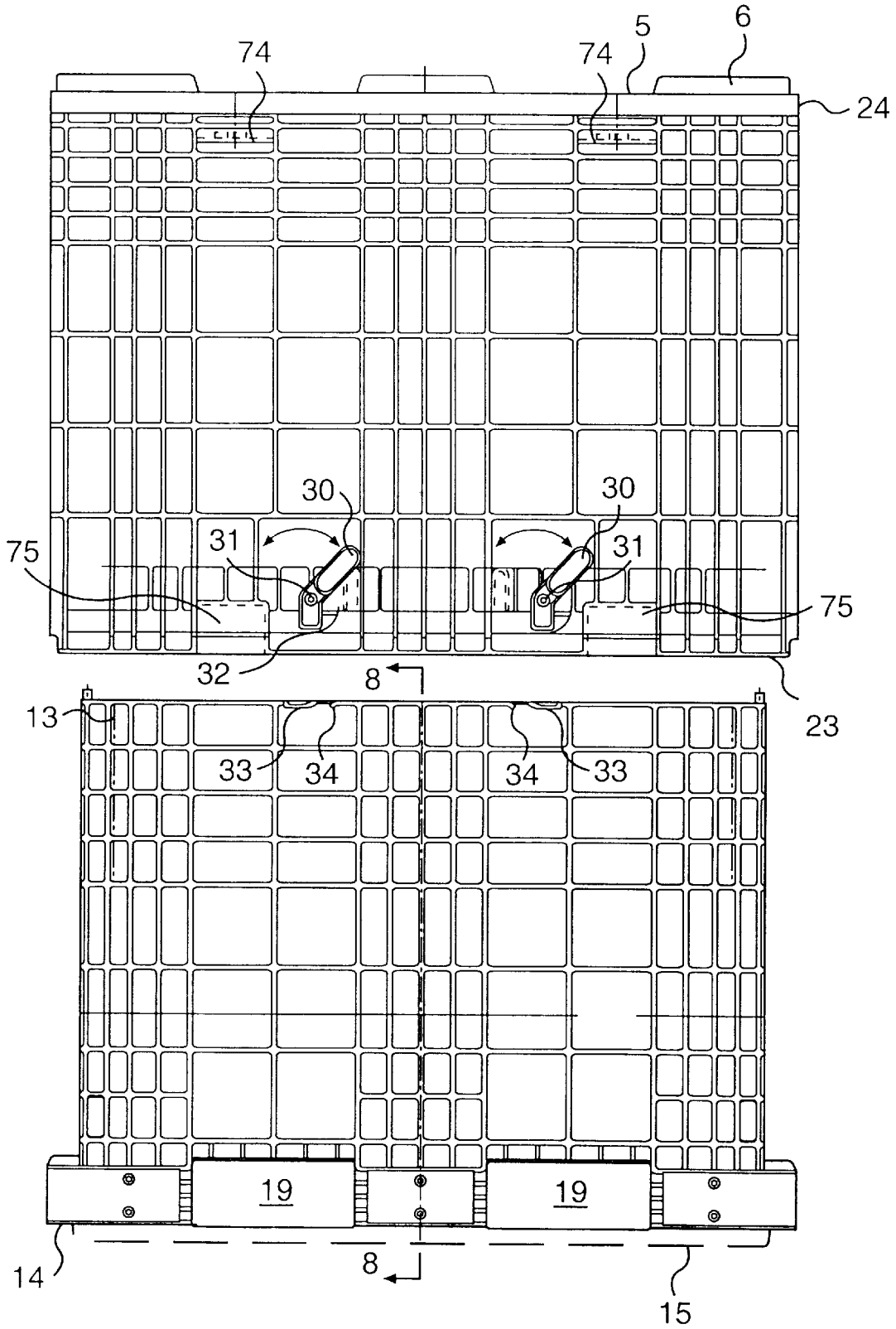
FIG. 6 is an end elevation view of the container shown in FIG. 5 with the base and ring parts separated to show the details of the latch that latches the ring to the base according to a preferred embodiment of the invention.

FIGS. 5 and 6 show that ring 20 is secured to base 10 using latches 30, two on the side walls 21 and two on the end walls 22 of the ring. The latches move between open and closed positions shown by the arrows. In FIGS. 5 and 6, the latches are shown in the closed or locked position. Latches 30 are secured to the side wall 21 of ring 20 by a screw 31 that forms a pivot. The shorter part of the arm 32 has a cantilevered flange that slips through an opening 34 along the top edge 13 of the base to engage the underneath side of a flange 33 on the base. The latches 30 secure the ring to the base to prevent the ring from being displaced with respect to the base. The latches are not intended to secure the ring 20 to the base 10 to such an extent that the container could be lifted by the ring when the container is full of several hundred pounds of a flowable material. However, the latches preferably are of sufficient strength to ensure that the ring and base do not become disconnected, particularly when the container is empty and in the upright position.

Figure 9:
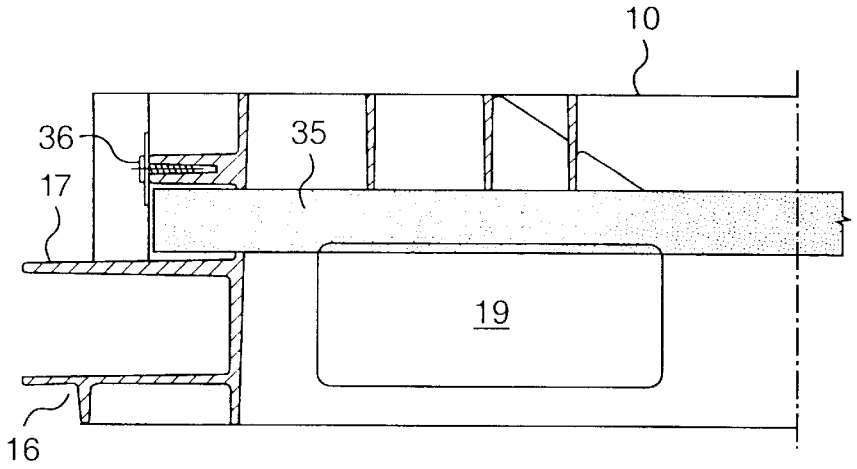
FIG. 9 is a sectional view taken along line 9—9 of FIG. 5.

For handling the container when it is full, a forklift is preferably used and in this regard forklift entryways 19 are provided in the bottom part 14 of the base, as shown in FIG. 6. Since the base and rim are preferably molded of a high strength plastic, which tends to offer little resistance against slipping off the tines of a forklift, two boards 35 are inserted in slots in the base 10, as shown in FIG. 5. The boards, as shown in FIG. 9, in particular, extend part way into the forklift entryways 19 to engage the tines of a forklift to prevent the container from sliding off of the tines when the containers are being handled with a forklift. Also, boards 35 provide structural rigidity to the base which is useful when the container is full of several hundred pounds of a flowable material. Although there are many ways to secure the boards within the slots formed in the base, a screw and washer assembly 36 is shown, which prevents the boards from sliding out of the slots in which they are inserted.

Figure 7:
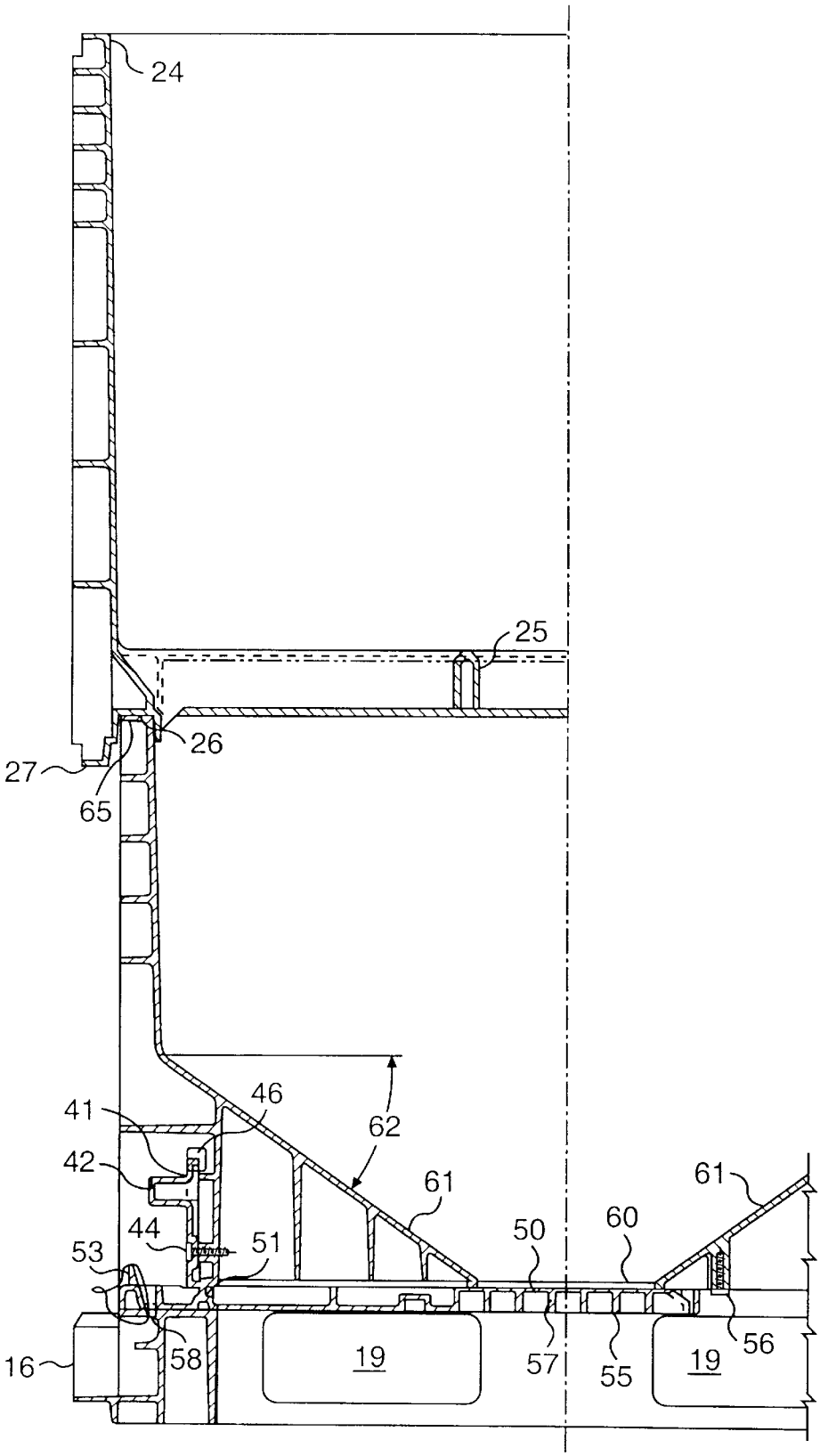
FIG. 7 is a sectional view taken along lines 7—7 in FIG. 5.

As shown in FIG. 7, an outlet 60 is provided in the bottom wall 61 of the base. The bottom wall 61 is angled downwardly with respect to the horizontal by an angle 62, which can range from between 15 to 40°, but which is preferably about 30–35°. Increasing the angle 62 speeds the flow of the material through outlet 60, but decreases the capacity of the container, so there is a tradeoff to be considered that establishes the preferred range of 30–35°.

Outlet 60 is normally closed by a cutoff device 50 that extends across the bottom of outlet 60. Along the sides of cutoff device 50 are metal tracks 55, also shown in FIG. 8, secured by a screw 56 to bosses on the bottom wall 61.

Figure 10:
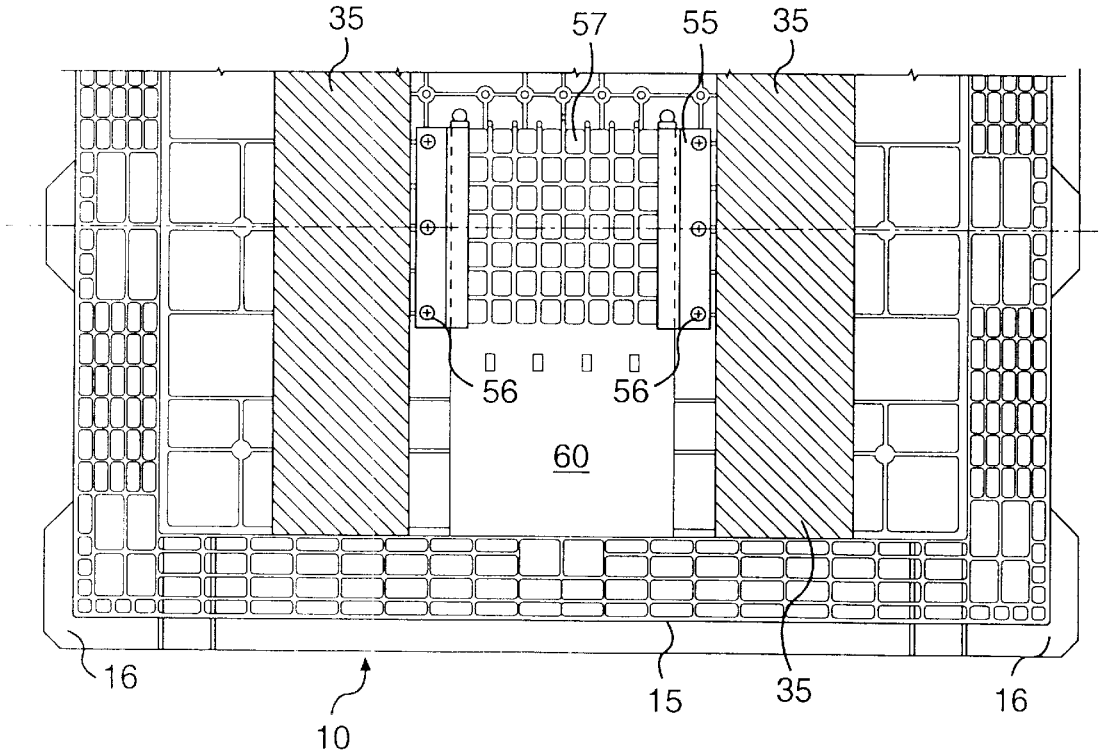
FIG. 10 is a partial bottom plan view of the container shown in FIG. 5.

Cutoff device 60 has a number of ribs 57 in FIG. 10 extending across the bottom of the device where it spans outlet 60, for providing structural integrity to the cutoff device. In operation, the cutoff device can be grasped at a pull 53 (FIG. 7) to withdraw or pull back the cutoff device for opening outlet 60 to the desired extent thereby controlling the flow of the contained material out of outlet 60. As shown in FIG. 10, there is no obstruction after the cut off device is open between outlet 60 and the space beneath the container so the flowable material is permitted to drop straight down out of the bottom of the container once the cutoff device 50 is withdrawn.

When the container is being shipped, the cutoff device is secured in the closed position using a locking arm 41, shown in FIGS. 5 and 7. A knob 42 is provided at one end of the arm 41 to manipulate the arm between two positions between the locked and unlocked positions shown at opposite ends of track 45 by the arrow. Locking arm 41 is secured to sidewall 11 of base 10 by a screw 44 that forms a pivot point. Movement of the arm between the two positions moves the end part 43 of the arm into a position engaging a flange 51 of the cutoff device, thereby preventing the cutoff device from being withdrawn from its opening in the base. FIG. 5 shows the locking arm 41 in the opened position and FIG. 7 shows the locking arm in the locked position. Stops 46 are provided at the ends of the track to restrict pivotal movement of the locking arm to about 90° overall.

To ensure that the cutoff device is withdrawn only by the customer or another authorized person, a security tie 53 can be provided that passes through an opening 58 in the base 10. The security tie could provide an indication of whether or not the cutoff device has been open.

Figure 8:
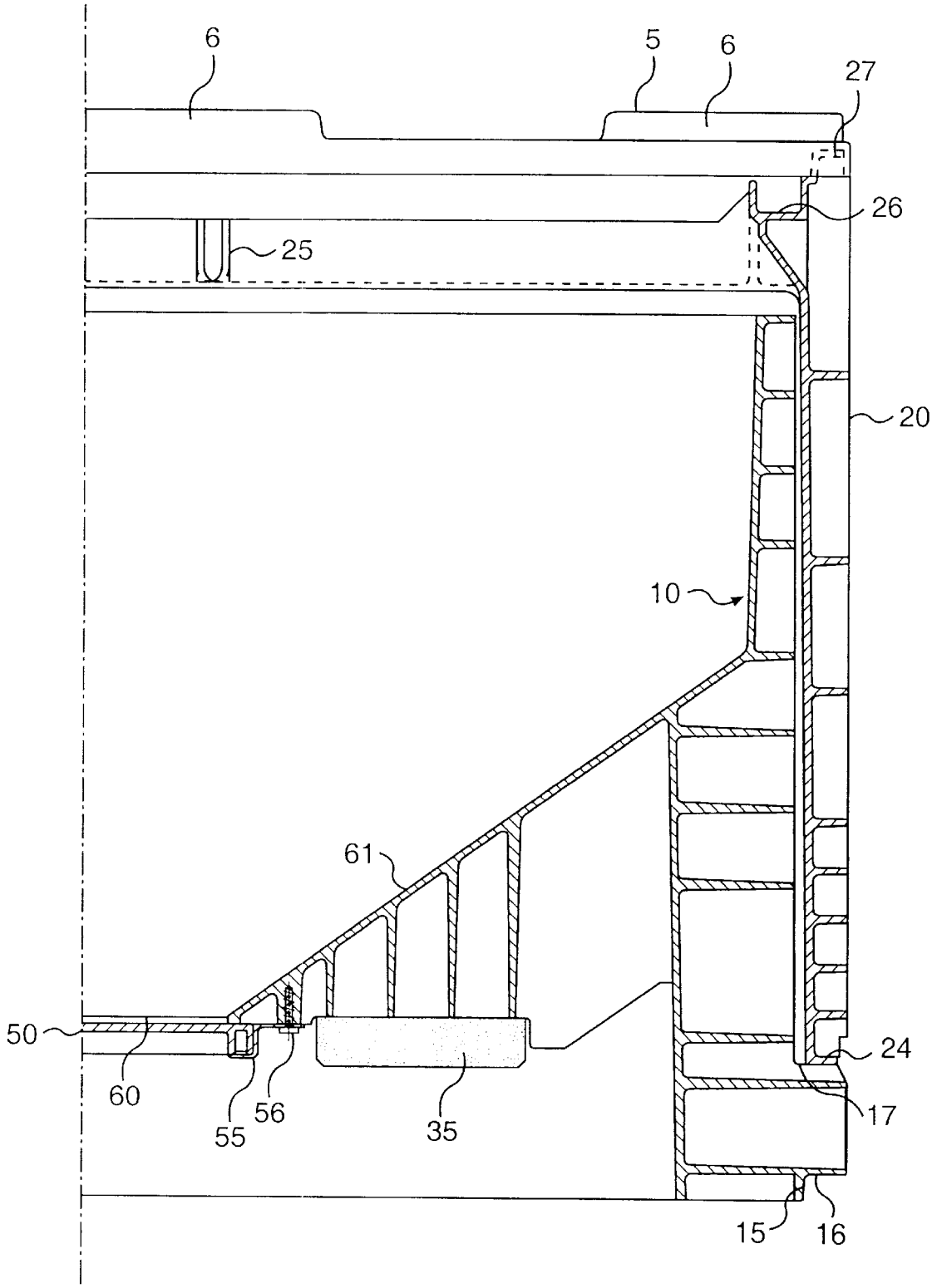
FIG. 8 is a sectional view taken along a line 8—8 shown in FIG. 6, but with the ring part in an inverted orientation shown placed over the periphery of the base.

FIG. 8 shows the collapsed position of the container after it has been used and the flowable material has been dispensed (although donnage space is available within the base). As shown, the bottom 27 of ring 20 is positioned at the top of the drawing and the inner peripheral flange 26, which receives the top flange 65 of the side and end walls of the base 10 when the containers are in the upright stacked position as shown in FIG. 7, is inverted, as shown in FIG. 8. Adjacent the bottom 27 is an outer peripheral flange that works with the inner periphery of lid 5 so that the lid is able to be fitted on the container in the collapsed position as well as in the upright position around top edge 24, as shown in FIG. 6.

As shown in FIGS. 8 and 10, with the ring inverted, the edge 24 rests on the top horizontal flange 17 which runs along the base between the corners 16 of the base 10. This allows the collapsed position of the container to have the same footprint as the container when it is in the upright position.

To provide for assistance with handling of the ring 20 for assembling the ring onto the base 10 for removing the ring from the base 10, upper handholds 74 are provided, as shown in FIGS. 5 and 6. Further, since the orientation of the ring 20 is turned upside down, lower handholds 75 are provided for handling the ring when it is in its inverted position for assembling or disassembling the ring from the collapsed position.

Although the preferred embodiment of the invention has been described with reference to the accompanying figures, those skilled in the art will recognize that variations and changes may be made without departing from the spirit and scope of the invention.

I claim:

1. A container for dispensing a flowable material, comprising:

a ring having side and end walls, an upper periphery and a lower periphery;

a base having side and end walls, an upper periphery, a lower periphery and a bottom wall integrally connected to said side and end walls of said base;

a dispensing outlet in said base for dispensing a flowable material through the bottom wall of said base;

a cutoff device for controlling flow of a flowable material through said outlet;

latches that detachably mount said ring on said base, wherein said lower periphery of said ring is latched to said upper periphery of said base with said latches in a first position in which a flowable material is contained in said container; and said ring being unlatched and removed from said base and inverted with respect to said first position of said ring so that said side and end walls of said ring slide over said side and end walls of said base in a second position in which said upper periphery of said ring is positioned adjacent said lower periphery of said base.

2. A container as claimed in claim 1, wherein said base is of a unitary construction having interior walls slanted downwardly and inwardly towards said outlet for directing flow of a flowable material to said outlet.

3. A container as claimed in claim 2, wherein said interior walls are angled to slope toward said opening at an angle from 15–40°.

4. A container as claimed in claim 3, wherein said interior walls are angled to slope toward said opening at an angle of 30–35°.

5. A container as claimed in claim 1, further including a lid adapted to fit onto said upper periphery of said ring in said first position and said lower periphery of said ring in said second position.

6. A container as claimed in claim 1, wherein said base has forklift entryways for receiving tines of a forklift.

7. A container as claimed in claim 6, further including at least one board extending in a slot in said base adjacent said forklift entryways for forming an engagement surface with tines of a forklift to minimize slipping of said container off of said tines of said forklift.

8. A container as claimed in claim 1, further including a lock for securing said cutoff device in a position closing said opening.

9. A container as claimed in claim 1, further including said ring having cross struts extending across an opening of said ring for supporting end and side walls of said ring.

10. A container as claimed in claim 1, further including said ring having a top edge formed about said upper periphery of said ring; and said base having a flange formed about said lower periphery of said base, wherein said top edge of said ring engages said top flange of said base in said second position.

* * * * *